United States Patent [19]

Masterson et al.

[11] Patent Number: 4,708,738

[45] Date of Patent: Nov. 24, 1987

[54] METHOD FOR REFINING VERY SMALL HEATS OF MOLTEN METAL

[75] Inventors: Ian F. Masterson, Danbury, Conn.; Jonathan J. Feinstein, North Salem; Lanier Stambaugh, Briarcliff Manor, both of N.Y.

[73] Assignee: Union Carbide Corporation, Danbury, Conn.

[21] Appl. No.: 932,000

[22] Filed: Nov. 18, 1986

Related U.S. Application Data

[62] Division of Ser. No. 846,800, Apr. 1, 1986, Pat. No. 4,647,019.

[51] Int. Cl.[4] ..... C21C 7/00

[52] U.S. Cl. ..... 75/59.1; 75/59.15; 75/59.22; 266/222; 266/243

[58] Field of Search ..... 266/222, 243; 75/59.15, 75/59.22, 10.17

[56] References Cited

U.S. PATENT DOCUMENTS

| | | | |
|---|---|---|---|
| 3,724,830 | 4/1973 | Saccomano et al. | 266/36 P |
| 3,816,720 | 6/1974 | Bauer et al. | 235/151.12 |
| 3,934,863 | 1/1976 | Norberg | 266/243 |
| 3,942,978 | 3/1976 | Ostberg | 75/10.17 |
| 3,967,955 | 7/1976 | Folgero et al. | 75/12 |
| 4,178,173 | 12/1979 | Gorges et al. | 75/60 |
| 4,190,435 | 2/1980 | Johnsson et al. | 75/12 |
| 4,208,206 | 6/1980 | Death | 75/60 |
| 4,356,035 | 10/1982 | Brotzman et al. | 75/52 |

FOREIGN PATENT DOCUMENTS 2082624 3/1982 United Kingdom .

*Primary Examiner*—Peter D. Rosenberg
*Attorney, Agent, or Firm*—Stanley Ktorides

[57] ABSTRACT

A steel refining vessel having a defined relatively long and thin configuration, and a steel refining method, particularly suited for the refining of heats of steel weighing two tons or less while enabling excellent heat retention and gas-metal reactions during refining.

7 Claims, 1 Drawing Figure

METHOD FOR REFINING VERY SMALL HEATS OF MOLTEN METAL

This application is a division of prior U.S. application Ser. No. 846,800 filing date, Apr. 1, 1986, now U.S. Pat. No. 4,647,019.

TECHNICAL FIELD

This invention relates to subsurface pneumatic steel refining and is an improvement whereby a relatively small amount of steel can be efficiently refined.

BACKGROUND OF THE INVENTION

Steel is refined in subsurface pneumatic refining vessels of many different sizes ranging from very large vessels capable of refining a heat of steel weighing 300 tons, to small vessels capable of refining a heat of steel weighing about five tons. Lately there has arisen a need to refine very small heats of steel weighing about two tons or less. Consequently there is a need for steel refining vessels sized to accommodate such very small heats.

At first glance it might appear that such a problem is easily solved by simply building a proportionally smaller steel refining vessel of the known design. Such a procedure has heretofore been effective in producing steel refining vessels of various sizes. For example, a 150 ton steel refining vessel and a 5 ton steel refining vessel have about the same design parameters despite their size difference.

A major problem in subsurface pneumatic steel refining is retaining enough heat within the steel melt during refining to ensure that the refined steel melt will be at the proper tap temperature after refining. This is because heat from external sources generally is not added to the melt during refining. Although some heat is generated by exothermic refining reactions such as decarburization or the oxidation of fuel elements, the melt during refining can experience a net heat loss. If the heat loss is such as to cause the melt to be below the proper tap temperature, the melt must undergo a time consuming and expensive reblow in order to attain the proper tap temperature.

Herein lies a major problem in the design of a very small steel refining vessel. As is well known, the heat loss of a mass is directly related to the ratio of its surface area to volume, i.e., the greater is the surface area of the mass for any given volume, the greater will be the rate of temperature loss of the mass. As steelmaking vessels of known design are made proportionately smaller, their surface area to volume ratio increases and thus the rate of temperature loss increases. This problem is even more acute when the AOD, or argon-oxygen decarburization, process is employed because of the use of inert diluent gas during refining which further contributes to heat loss. The AOD process is a preferred steel refining process due to the cleanliness and pinpoint constituent accuracy of steel refined by this process.

Another major problem in the design of a very small steel refining vessel is the need to achieve a conducive gas liquid interface and gas residence time for efficient gas-metal reactions. Especially when employing the AOD process it is advantageous to maintain a sufficient volume of molten metal above the point at which the refining gases are injected into the molten metal in order to obtain efficient utilization of injected gases used for removing impurities by degassing, deoxidation, volatilization or by flotaton of said impurities with subsequent entrapment or reaction with the slag and gases used for alloying.

Examples of known subsurface pneumatic steel refining vessels can be found in many references including U.S. Pat. No. 3,724,830—Molten Metal Reactor Vessel, U.S. Pat. No. 3,816,720—Process For The Decarburization of Molten Metal and U.S. Pat. No. 4,208,206—Method For Producing Improved Metal Castings By Pneumatically Refining The Melt.

Accordingly, it is an object of this invention to provide an improved subsurface pneumatic steel refining vessel which will enable one to more efficiently refine a heat of steel weighing about two tons or less.

It is a further object of this invention to provide an improved subsurface pneumatic steel refining vessel which will enable one to more efficiently refine a heat of steel weighing about two tons or less by use of the AOD process.

It is another object of this invention to provide an improved subsurface refining method to efficiently refine a heat of steel weighing about two tons or less.

SUMMARY OF THE INVENTION

The above and other objects which will become apparent to one skilled in the art upon a reading of this disclosure are attained by this invention one aspect of which is:

A subsurface pneumatic steel refining vessel having a relatively long and thin configuration and particularly suited for refining heats of steel weighing about two tons or less, comprising a sidewall and a bottomwall cooperating to define a volume of not more than 25 cubic feet, said sidewall comprising a straight section, perpendicular to and spaced from the bottomwall, and a sloped section, between and in contact with the straight section and the bottomwall, the height of the straight section being at least 1.6 times the height of the sloped section, the volume defined by the sloped section being not more than 30 percent of the total volume of the vessel and having a minimum diameter at least 0.3 times the height of the sloped section.

Another aspect of this invention is:

A method for refining a steel melt weighing about two tons or less comprising: (1) providing a steel melt weighing about two tons or less to a steel refining vessel having a relatively long and thin configuration, at least one tuyere, and a sidewall and a bottomwall cooperating to define a volume of from 2.0 to 3.9 times the volume of the steel melt, said sidewall comprising a straight section, perpendicular to and spaced from the bottomwall, and a sloped section, between and in contact with the straight section and bottomwall, the height of the straight section being at least 1.6 times the height of the sloped section, the volume defined by the sloped section being not more than 30 percent of the total volume of the vessel and having a minimum diameter at least 0.3 times the height of the sloped section; (2) injecting refining gas(es) into the steel melt through said tuyere(s); (3) maintaining the melt surface at least 10 inches above at least one gas injection point; and (4) maintaining a freeboard of at least 22 inches.

As used herein, the term "vessel axis" means an imaginary line running through the approximate geometric center of a steel refining vessel in the longitudinal direction.

As used herein, the term "side injection" means the injection of refining gas or gases into a steel refining vessel at an angle perpendicular, or within 45 degrees of perpendicular, to the vessel axis.

As used herein, the term "tuyere" means a device through which gas is conveyed to and injected into a steel melt.

As used herein, the term "bath" means the contents inside a steelmaking vessel during refining, and comprising a melt, which comprises molten steel and material dissolved in the molten steel, and a slag, which comprises material not dissolved in the molten steel.

As used herein, the term "melt surface" means the calculated quiescent level of molten metal in a refining vessel.

As used herein, the term "volume of molten metal" means the calculated quiescent volume of molten metal obtained by dividing the weight of metal by its density.

As used herein, the term "gas injection point" means the point where gas is injected into a steel melt through a tuyere.

As used herein, the term "freeboard" means the distance from the melt surface to the top of the vessel proper.

As used herein, the terms "argon oxygen decarburization process" or "AOD process" mean a process for refining molten metals and alloys contained in a refining vessel provided with at least one submerged tuyere comprising:

(a) injecting into the melt through said tuyere(s) an oxygen-containing gas containing up to 90 percent of a dilution gas, wherein said dilution gas may function to reduce the partial pressure of the carbon monoxide in the gas bubbles formed during decarburization of the melt, alter the feed rate of oxygen to the melt without substantially altering the total injected gas flow rate, and/or serve as a protective fluid, and thereafter (b) injecting a sparging gas into the melt through said tuyere(s), said sparging gas functioning to remove impurities from the melt by degassing, deoxidation, volatilization or by floatation of said impurities with subsequent entrapment or reaction with the slag. Useful dilution gases include argon, helium, hydrogen, nitrogen, steam or a hydrocarbon. Useful sparging gases include argon, helium, hydrogen, nitrogen, carbon monoxide, carbon dioxide, steam and hydrocarbons. Argon and nitrogen are preferred dilution and sparging gases. Argon, nitrogen and carbon dioxide are the preferred protective fluids.

DETAILED DESCRIPTION

Figure 1:
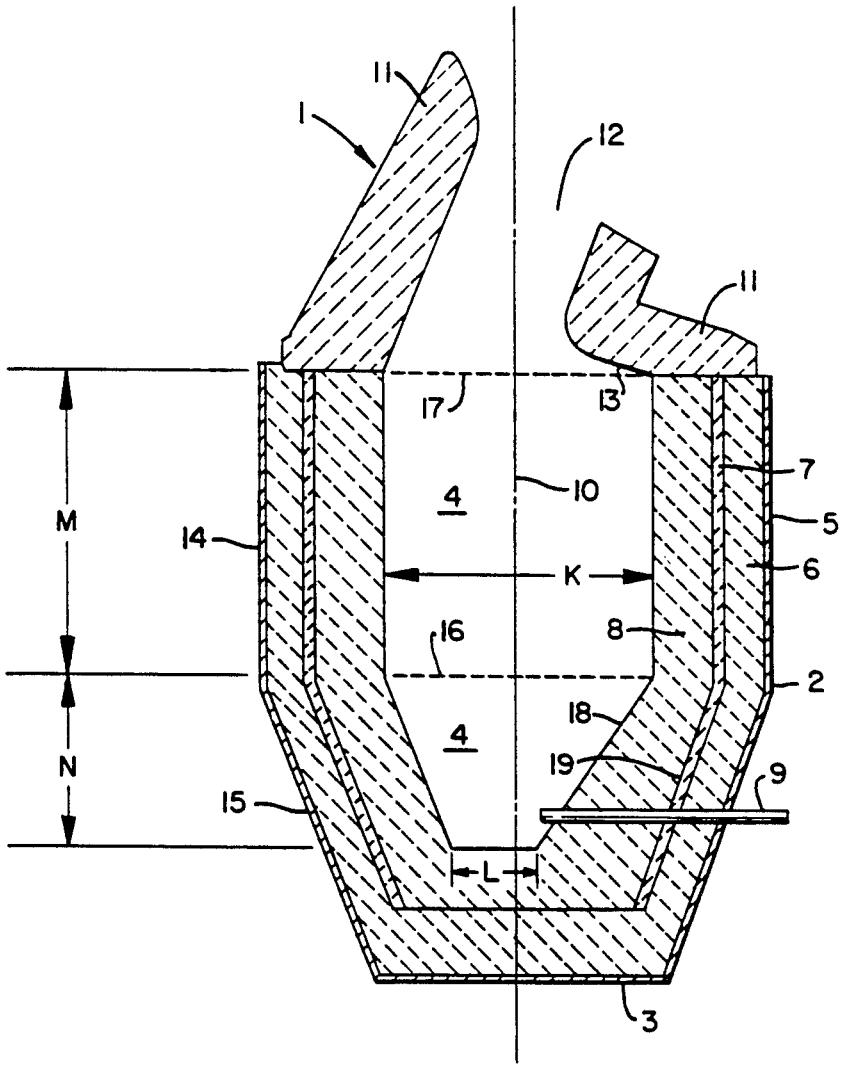
FIG. 1 is a simplified cross-sectional representation of a preferred embodiment of the subsurface pneumatic steel refining vessel of this invention which is particularly useful in carrying out the AOD process.

The steel refining vessel of this invention will be described in detail with reference to the drawing.

Referring now to FIG. 1, steel refining vessel 1 is comprised of sidewall 2 and bottomwall 3 which cooperate to define an internal volume 4 which does not exceed 25 cubic feet and preferably does not exceed 20 cubic feet. The internal volume 4 is from about 2.0 to 3.9 times, preferably from about 2.3 to about 2.9 times, the volume of molten metal which is being refined. The sidewall and bottomwall comprise an outer thin metal lining 5, termed the vessel shell, which is lined with refractory. In the embodiment of FIG. 1, a three-part refractory is illustrated comprising safety lining 6 adjacent the metal shell, refractory fill 7 adjacent the safety lining, and consumable lining 8 adjacent the refractory fill on one side and defining internal volume 4 on the other side. For ease of representation, the outline of the various parts of the refractory lining are shown in FIG. 1 as being smooth. Those skilled in the art will recognize that the refractory lining parts may be comprised of individual bricks in which case the outline of the refractory lining may be stepped. In such a case, the smooth lines shown in FIG. 1 would be approximations. The preferred materials for safety lining 6 include magnesite chromite. The preferred materials for refractory fill 7 include magnesite chromite and zirconia. The preferred materials for consumable lining 8 include magnesite chromite and dolomite.

Refining vessel 1 is provided with at least one tuyere 9 through which gas is injected into molten metal contained within the vessel during refining. The tuyere is oriented so as to inject the gas or gases into the melt at or near the bottomwall. During refining the melt surface is at least 10 inches, and preferably is at least 12 inches, above the gas injection point of at least one tuyere. Although not shown in FIG. 1, those skilled in the art will recognize that tuyere 9 is connected to a source of such refining gas or gases. FIG. 1 illustrates a preferred side-injected embodiment of the steel refining vessel of this invention wherein tuyere 9 passes through sidewall 2 and enables injection of gas into the steel melt perpendicular, or within 45 degrees of perpendicular, to the vessel axis 10. The tuyere or tuyeres may also pass through the bottomwall enabling injection of gas into the steel melt parallel, or within 45 degrees of parallel, to the vessel axis.

Refining vessel 1 is provided with a cover 11 attached to sidewall 2 which forms the vessel mouth 12 through which the unrefined steel is introduced to, and the refined steel removed from, vessel 1. In the embodiment of FIG. 1 the cover 11 is a castable refractory cover. Alternatively the cover could be a bricked cover. The preferred materials for a castable refractory cover include low phosphorus high alumina castable refractory. The preferred materials for a bricked cover include magnesite chromite and dolomite.

A castable refractory cover is preferred because it can be easily cast into a shape having a surface 13 which is substantially perpendicular to the vessel axis 10, i.e., facing the molten metal bath, thereby reducing spitting of molten metal from the vessel during refining without the need for greater freeboard, reducing heat loss during refining by providing a surface which radiates heat back to the melt, and reducing air infiltration into the vessel by enabling the construction of the vessel mouth to be smaller and to present a more tortuous pathway for the infiltrating air to traverse.

Sidewall 2 comprises a straight section 14 and a sloped section 15. Straight section 14 is essentially parallel to vessel axis 10 and thereby essentially perpendicular to bottomwall 3. Straight section 14 is spaced from bottomwall 3 and sloped section 15 fits in this space so as to be between and in contact with straight section 14 and bottomwall 3. The height M of straight section 14, i.e., the length of the straight section perpendicular to the bottomwall, is at least 1.6 times, and preferably at least 1.8 times, the height N of sloped section 15, i.e., the length of the sloped section perpendicular to the bottomwall. In this way vessel 1 has a relatively long and thin configuration. As is recognized, the total height of the sidewall is the sum of M plus N. The height M should not exceed the height N by more than about 3.0 times.

The volume defined by sloped section 15, which in FIG. 1 is the volume below dotted line 16, is not more than 30 percent and preferably is at least 15 percent of the total internal volume 4 of the vessel. In FIG. 1 total internal volume 4 is the volume below dotted line 17. In this way a smaller then heretofore conventional percentage of the molten metal bath resides in the lower portion of the vessel during refining.

Another method of specifying the long and thin shape of the steel refining vessel of this invention is to relate the diameter of the straight section volume to the height of the sloped section, wherein this diameter K of the straight section volume preferably is at least 1.5 but not more than 2.0 times the height N of the sloped section.

It is also important to the proper functioning of the steel refining vessel of this invention that the minimum diameter of the volume defined by the sloped section, i.e. the diameter generally at the bottom of the sloped section when the vessel is upright, be at least 0.3 times the height N of the sloped section. In FIG. 1, this minimum diameter is defined as L. This is important because, due to the small size of the vessel, and especially when side injection is employed, if the opposite sides of the sloped section converge too closely together, in the vicinity of the point of gas injection there will occur a disadvantageously high rate of refractory wear. The ratio of L to M is preferably at least 0.5 and it is preferred that this ratio not exceed 1.5. In practice it has been found that the diameter L should generally be at least six inches.

The long and thin steel refining vessel of this invention is an unobvious solution to the problem of intolerable heat loss in a small refining vessel due to a high surface area to volume ratio. The apparent engineering solution to such a problem is to make the vessel as spherical as possible since it is well known that the surface area to volume ratio of any given mass approaches a minimum as the shape of the mass approaches that of a sphere. The steel refining vessel of this invention, however, is a change from the conventional design not in the direction toward a sphere, but, in fact, in the opposite direction, toward a long and thin configuration, which conventional knowledge would indicate to be a poor design for heat retention. However, applicants have unexpectedly found that their unconventional long and thin design is better suited for refining steel heats weighing less than about two tons than are the more spherical conventional steel refining vessels.

While not wishing to be held to any theory, applicants offer the following explanation for the unexpected advantages which are attainable with this invention. While applicants' design does allow for increased heat loss through the vessel surface area over that of conventionally designed vessels, applicants' design enables a significant reduction in the heat loss through the vessel mouth. This is because applicants' long and thin design enables the molten metal bath surface to sit proportionately lower than where it would be with a conventional design. The freeboard, i.e. the distance from the melt surface to the top of the vessel proper represented by line 17, is at least 22 inches and preferably is at least 28 inches. Thus spitting, with the attendant heat loss is reduced over what it would be with a conventional design and a significant amount of heat from the bath surface is reflected by the inside of the vessel above the bath surface as well as the vessel cover and is radiated back to the bath. Applicants believe that these heat savings, which would be lost with a conventionally designed steel refining vessel, more than compensate for the added heat lost through the increased surface area of their long and thin vessel. Furthermore, the steel refining vessel of this invention enables a sufficient volume of molten metal to be maintained above the point at which the refining gases are injected into the molten metal enabling the efficient utilization of the refining gases.

If the melt surface were to be below 10 inches above the gas injection point there would not be sufficient metal above the gas injection point to provide a good gas-metal interface to enable efficient refining of the small melt. Also if the freeboard were to be less than 22 inches there would be excessive heat loss from the vessel mouth resulting in inefficient refining. As is evident from this disclosure, applicants' invention teaches that as the size of the steel melt to be refined is smaller, the optimal steel refining vessel for such melt is relatively more cylindrical (longer and narrower) than spherical. This surprising result is contrary to heretofore conventional thought concerning steelmaking vessel design.

FIG. 1 illustrates a particularly preferred embodiment of the steel refining vessel of this invention wherein the thickness of the consumable refractory lining on the sloped section in the tuyere area is not constant but substantially constantly decreases from tuyere 9 to a point above tuyere 9. The lining thickness is the distance between lining hot face 18 and lining cold face 19 perpendicular to the vessel axis. In this preferred embodiment, the hot face axis angle, i.e., the degree of angle from the vessel axis, is greater than the cold face axis angle, from the tuyere to a point such that the lining thickness at the tuyere is at least ten percent greater than the lining thickness at said point. In the embodiment of FIG. 1, the said point is the conjunction of the straight and sloped sections of the sidewall. This preferred consumable lining configuration enables more efficient lining usage.

The steel refining vessel of this invention is particularly suited for refining a heat of steel weighing about two tons or less. The invention is useful in refining virtually all known steels such as stainless steel, low alloy steels and tool steels, and can be used with any subsurface pneumatic injection steel refining process such as the AOD, CLU, LWS or Q-BOP process to refine steels for all uses such as the production of ingots or final product castings.

EXAMPLE

The following example of this invention is presented for illustrative purposes and is not intended to be limiting.

An AOD steel refining vessel of this invention was constructed for refining one ton heats of steel. The volume of the vessel was 13 cubic feet which is about 3.4 times the volume of a ton of molten steel. The vessel straight section was 29 inches high and had a diameter of 26 inches, and the vessel sloped section was 16 inches high and had a minimum diameter at the vessel bottom of 14.5 inches. Thus, the height of the straight section exceeded 1.6 times the height of the sloped section and the minimum diameter of the sloped section exceeded 0.3 times the height of the sloped section. One tuyere passed through the sloped section wall and communicated with the internal volume about two inches above the bottomwall. The sloped section in the vicinity of the tuyere was tapered in thickness from the tuyere, where it was 10.7 inches thick, to the intersection of the straight section and the sloped section, where it was 6.0 inches thick, such that the tapered section hot face was sloped 35° to the vessel axis. The thickness of the refractory working lining was 6 inches in all parts of the vessel other than the tapered section. Behind this working refractory lining was a safety refractory lining which is not consumed or replaced each campaign. The working lining of the vessel was comprised of magnesite-chromite refractory. The vessel cover was comprised of castable high alumina refractory having a planar hot face where it joined the top of the straight section. The pouring spout in the cover was cylindrical with a 14 inch diameter, was situated diametrically opposite the tuyere, and was sloped 30° to the vessel axis.

Thirty one-ton heats of carbon steels, highly alloyed steels and nickel-based metals were refined using this vessel. After these thirty heats the refractory thickness was reduced by 4.25 inches at the tuyere. There was virtually no slopping during these heats and only a small amount of refractory wore out at the cover hot face. The heat loss rate was about 6.5° F./minute when no gases were being injected. It is estimated that about 75 or more heats could be refined before major equipment maintenance, such as a lining change, would be necessary.

COMPARATIVE EXAMPLE

The following example is presented for comparative purposes.

An AOD steel refining vessel of a conventional design was constructed for refining two ton heats of steel. The volume of the vessel was 21.7 cubic feet which is 2.44 times the volume of two tons of molten steel. The vessel straight section was 22 inches high and had a diameter of 37 inches, and the vessel sloped section was 19 inches high and had a minimum diameter at the vessel bottom of 22.5 inches. Thus the height of the straight section was less than 1.6 times height of the sloped section and thus this vessel did not have a relatively long and thin configuration. Two tuyeres passed through the sloped section wall and communicated with the internal volume about 3.5 inches above the bottomwall. The sloped section in the vicinity of the tuyeres was tapered in thickness from the tuyeres, where it was 9 inches thick, to the intersection of the straight section and the sloped section, where it was 6 inches thick, such that the tapered section hot face was sloped 26° to the vessel axis. The thickness of the refractory working lining was 6 inches in all parts of the vessel other than the tapered section. Behind this working refractory lining was a safety refractory lining which is not consumed or replaced each campaign. The working lining of the vessel was comprised of magnesite-chromite refractory. The vessel cover was comprised of castable high alumina refractory having a planar hot face where it joined the top of the straight section. The pouring spout in the cover was cylindrical with a 14 inch diameter, was situated diametrically opposite the tuyeres, and was sloped 30° to the vessel axis.

The vessel was used for refining two-ton heats of high alloy and low alloy steels. After 22 such heats the vessel failed. The refractory in the cover of the vessel wore out completely and during the heats a considerable amount of molten metal was ejected from the vessel. After the 22 heats about 3.5 inches of refractory had worn out at the tuyeres.

As can be seen from a comparison of the results with the invention and the results with a comparable steel refining vessel of conventional design, the steel refining vessel and method of this invention enables the far more efficient refining of steel melts weighing about two tons or less, as compared with that possible with conventionally designed steel refining vessels.

Although the invention has been described in detail with reference to certain specific embodiments, it is understood that there are other embodiments of the invention within the spirit and scope of the claims.

We claim:

1. A method for refining a molten metal melt weighing about two tons or less comprising: (1) providing a melt weighting about two tons or less to a refining vessel having no external heater, at least one tuyere, and a sidewall and a bottomwall cooperating to define a volume of from 1.8 to 3.9 times the volume of the melt, said sidewall comprising a straight section, perpendicular to and spaced from the bottomwall, and an inwardly sloped section, between and in contact with the straight section and bottomwall, the height of the straight section being at least 1.6 times the height of the inwardly sloped section, the volume defined by the inwardly sloped section being not more than 30 percent of the total volume of the vessel and having a minimum diameter at least 0.3 times the height of the inwardly sloped section; (2) injecting refining gas(es) into the melt through said tuyere(s); (3) maintaining the melt surface at least 10 inches above at least one gas injection point; and (4) maintaining a freeboard of at least 22 inches.

2. The method of claim 1 wherein the melt surface is at least 12 inches above at least one gas injection point.

3. The method of claim 1 wherein the freeboard is at least 28 inches.

4. The method of claim 1 wherein the steel refining process is the AOD process.

5. The method of claim 1 further comprising pouring the refined melt into at least one mold to form a cast product.

6. The method of claim 1 wherein said melt is steel.

7. The method of claim 1 wherein said melt is a nickel-based metal.

* * * * *